US007806096B2

(12) United States Patent
Grant

(10) Patent No.: US 7,806,096 B2
(45) Date of Patent: Oct. 5, 2010

(54) IN-LINE INDUCTION SYSTEM FOR INTERNAL COMBUSTION ENGINE

(76) Inventor: Barry S. Grant, Route 1, Box 1900, Dahlonega, GA (US) 30533

( * ) Notice: Subject to any disclaimer, the term of this patent is extended or adjusted under 35 U.S.C. 154(b) by 791 days.

(21) Appl. No.: 11/810,212

(22) Filed: Jun. 5, 2007

(65) Prior Publication Data

US 2008/0302326 A1 Dec. 11, 2008

(51) Int. Cl.
*F02M 35/104* (2006.01)
*F02M 11/02* (2006.01)

(52) U.S. Cl. ..... 123/184.46; 261/23.2; 261/36.2; 261/41.2; 74/471 R; 123/579; 123/583; 123/584; 123/184.32; 123/442

(58) Field of Classification Search ..... 123/579, 123/583, 584, 580, 184.46, 184.23, 184.21, 123/184.32, 184.38, 184.39, 54.4, 54.7, 58.1, 123/59.5, 434, 442; 261/DIG. 36, DIG. 52, 261/23.2, 36.2, 41.2, 41.3; 74/469, 471 R
See application file for complete search history.

(56) References Cited

U.S. PATENT DOCUMENTS 2,811,862 A 11/1957 Libby
2,989,956 A * 6/1961 Drinkard et al. ..... 123/545
3,003,488 A * 10/1961 Carlson ..... 123/584
3,030,819 A 4/1962 Edelbrock, Jr.
3,035,601 A 5/1962 Moseley
4,016,838 A * 4/1977 Yoshioka et al. ..... 123/583
5,809,972 A 9/1998 Grant
5,863,470 A 1/1999 Grant

OTHER PUBLICATIONS

Popular Hot-Rodding, Mar. 2007, vol. 47 #3, pp. 54-61.

* cited by examiner

*Primary Examiner*—Michael Cuff
*Assistant Examiner*—Hung Q Nguyen
(74) *Attorney, Agent, or Firm*—Thomas, Kayden, Horstemeyer & Risley, LLP

(57) ABSTRACT

In line carburetor (104) is mounted to a manifold (140) over the engine (800). The barrels of the carburetor deliver air/fuel suspensions to concentrated positions (152) of the manifold, with the concentrated positions being at opposite ends of the engine. The ports leading from the manifold to the runners are equally positioned about the concentrated positions (152) so that the runners are of substantially equal length and resistance, thereby providing more uniform delivery of the air/fuel suspension to the cylinders.

17 Claims, 7 Drawing Sheets

IN-LINE INDUCTION SYSTEM FOR INTERNAL COMBUSTION ENGINE

TECHNICAL FIELD

This present disclosure generally relates to an induction system for an internal combustion engine, and more particularly relates to an in-line carburetor and manifold for a high-performance internal combustion engine.

BACKGROUND

An internal combustion engine produces mechanical motion by combusting air and fuel. The engine includes a plurality of cylinders, and each cylinder has one or more intake valves that intermittently open to allow a combustible suspension of air and fuel into the cylinder. One type of internal combustion engine is a V-8 engine that has eight cylinders in two parallel banks of four cylinders arranged in a "V" orientation.

In some cases, the engine employs a carburetor that creates the air and fuel suspension, and an intake manifold that communicates the air and fuel suspension in a stream from the carburetor to the cylinders. More specifically, the carburetor includes one or more open-ended barrels, and air streams drawn by the cylinders of the engine flow through a venturi throat in each open-ended barrel. The air streams are accelerated as they pass the venturi throats and are reduced in pressure. The low pressure air streams at the venturis are used to draw fuel into the air streams and atomize the fuel in the air streams. Runners extending from the carburetor direct the air/fuel streams from the open-ended barrels of the carburetor to a common plenum, or intake area, within the intake manifold, and a plurality of runners extending from the plenum communicate the air/fuel suspension to each of the cylinders of the combustion engine.

One type of carburetor often used with high-performance engines is a four barrel carburetor having four open-ended barrels arranged in a square array. When a four open-ended barrel carburetor is used, the plenum is relatively square in shape and is relatively smaller than the engine, with the runners extending away from the plenum in differing directions to direct the air/fuel mixture to the cylinders of the engine.

The configuration described above enables sequential servicing of a plurality of cylinders with the full output of a single carburetor. However, the configuration may reduce the quality of the air/fuel suspension delivered to some of the cylinders. For example, the intake valves of the engine are located at various positions on the cylinder head and the runners usually have different lengths and shapes to reach from the plenum to the intake valves. Additionally, when the air and fuel suspension enters the intake manifold, the suspension may be relatively farther away from the openings into some runners than into other runners. As a result, the air and fuel suspension may favor entering one runner over another, or may have more difficulty traveling through one runner than another. It is apparent that a need exists for a carburetor and intake manifold that solves these and other problems.

SUMMARY

Briefly described, the present invention concerns an induction system for a combustion engine having two banks of parallel cylinders arranged in a V-shape. The induction system includes a four barrel carburetor body that has in sequence first, second, third and fourth barrels, with the barrels arranged in a row that provide air/fuel streams to the cylinders of the engine. Two barrels, such as the first and third barrels comprise primary barrels and the other two barrels, such as the second and fourth barrels comprise secondary barrels. Butterfly valves are positioned in alignment with each of the barrels and control the air/fuel streams passing through the barrels. A valve linkage is connected to the butterfly valves and is configured for opening the butterfly valves of the primary barrels and for opening the butterfly valves of the secondary barrels after the butterfly valves of the primary barrels are opened.

The valve linkage may be configured to rotate the butterfly valves of the primary barrels in opposite directions from the rotation of the butterfly valves of the secondary barrels. The barrels of the carburetor are arranged in a common plane of alignment and the control linkage configured to tilt the butterfly valves about axes normal to the common plane of alignment.

In one embodiment, the carburetor is mounted on a manifold and the manifold is mounted on the engine. The butterfly valves of the adjacent primary and secondary barrels of the carburetor are arranged to tilt when they are being opened so that their top surfaces rotate toward facing relationship. This tends to develop air/fuel streams that move between the butterfly valves to more concentrated locations in the manifold below the adjacent primary and secondary barrels. The concentrated locations in the manifold are close to the cylinders of the engine that they serve. For example, when the induction system is used with a V-8 engine, one of the concentrated positions for the air/fuel streams delivered by the first and second barrels will be adjacent the four cylinders at one end of the engine and the other concentrated position for the air/fuel streams delivered by the third and fourth barrels will be located close to the cylinders at the opposite end of the engine.

Induction runners extend from the concentrated positions in the manifold and deliver air/fuel streams to the nearest cylinders of the engine. This arrangement allows all of the induction runners to be made with substantially equal lengths and therefore with substantially equal resistance applied to their air/fuel streams. This also tends to cause the air/fuel streams to be delivered to the cylinders of the engine in more equal volumes and velocities.

Other systems, devices, methods, features, and advantages of the disclosed induction system will be apparent or will become apparent to one with skill in the art upon examination of the following figures and detailed description. All such additional systems, devices, methods, features, and advantages are intended to be included within the description and are intended to be protected by the accompanying claims.

BRIEF DESCRIPTION OF THE DRAWINGS

The present disclosure may be better understood with reference to the following figures. Matching reference numerals designate corresponding parts throughout the figures, and components in the figures are not necessarily to scale.

DETAILED DESCRIPTION

Described below are embodiments of an in-line induction system 102 for an internal combustion engine. In this embodiment the carburetor is to be mounted on a V-8 combustion engine having four cylinders in a left bank of cylinders and four cylinders in a right bank of cylinders.

Figure 5:
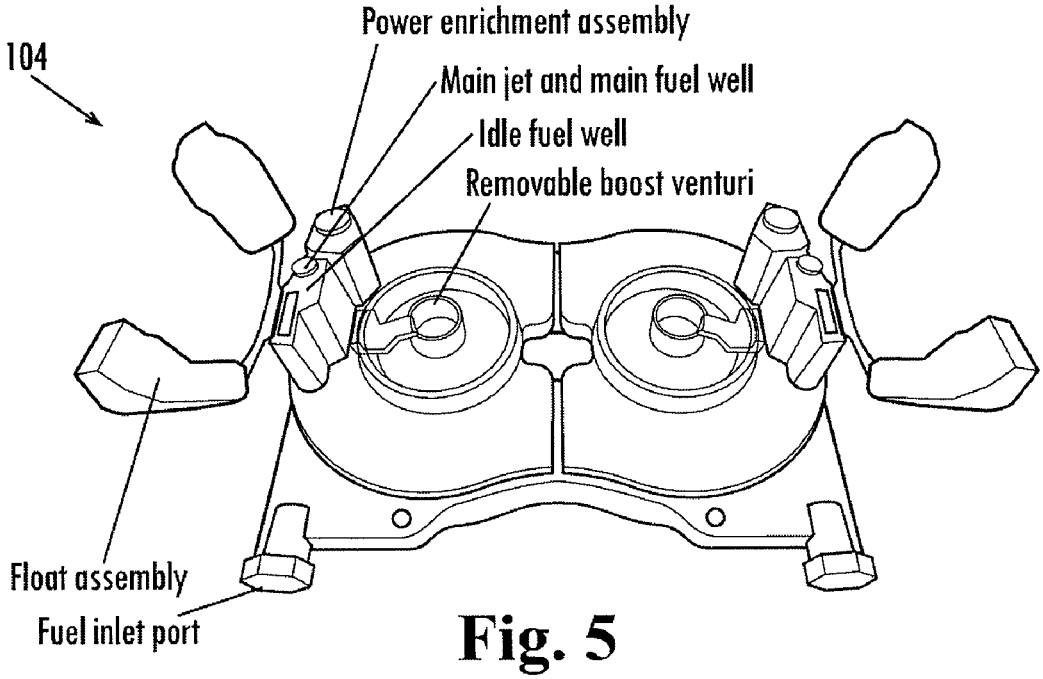
FIG. 5 is a bottom view of a portion of the in-line carburetor shown in FIG. 1, illustrating an embodiment of fuel-metering circuits for one pair of barrels.
Figure 6:
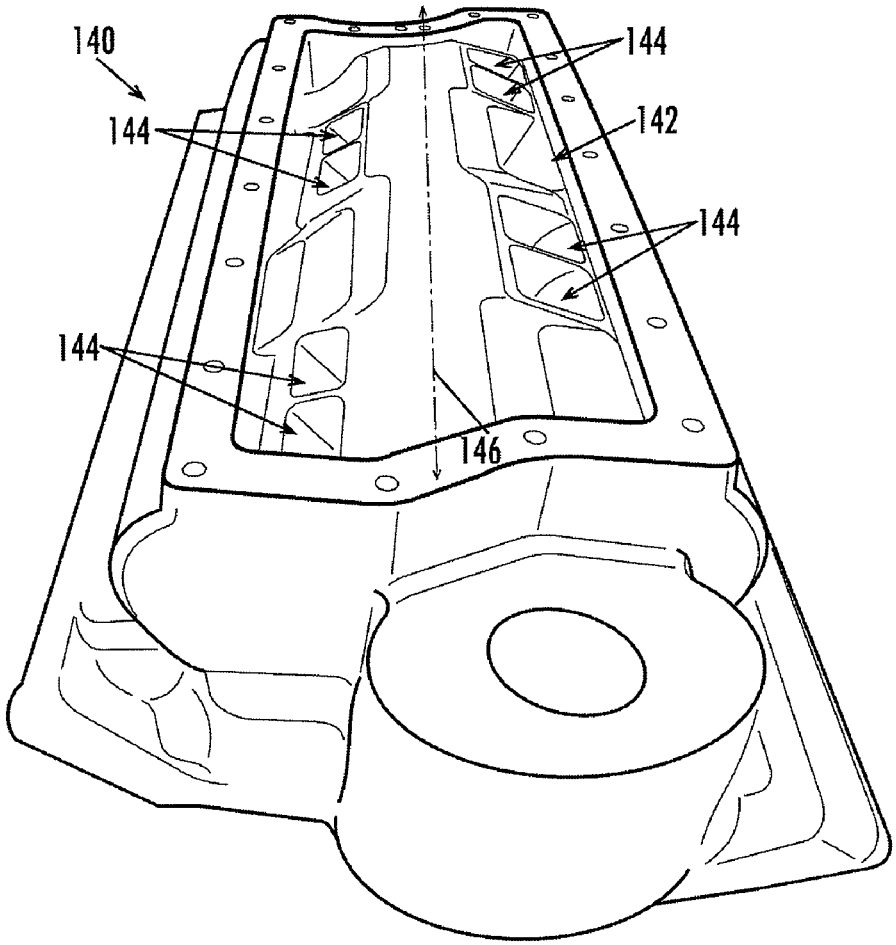
FIG. 6 is perspective view of an intake manifold that is designed to be used with the in-line carburetor shown in FIG. 1.
Figure 7:
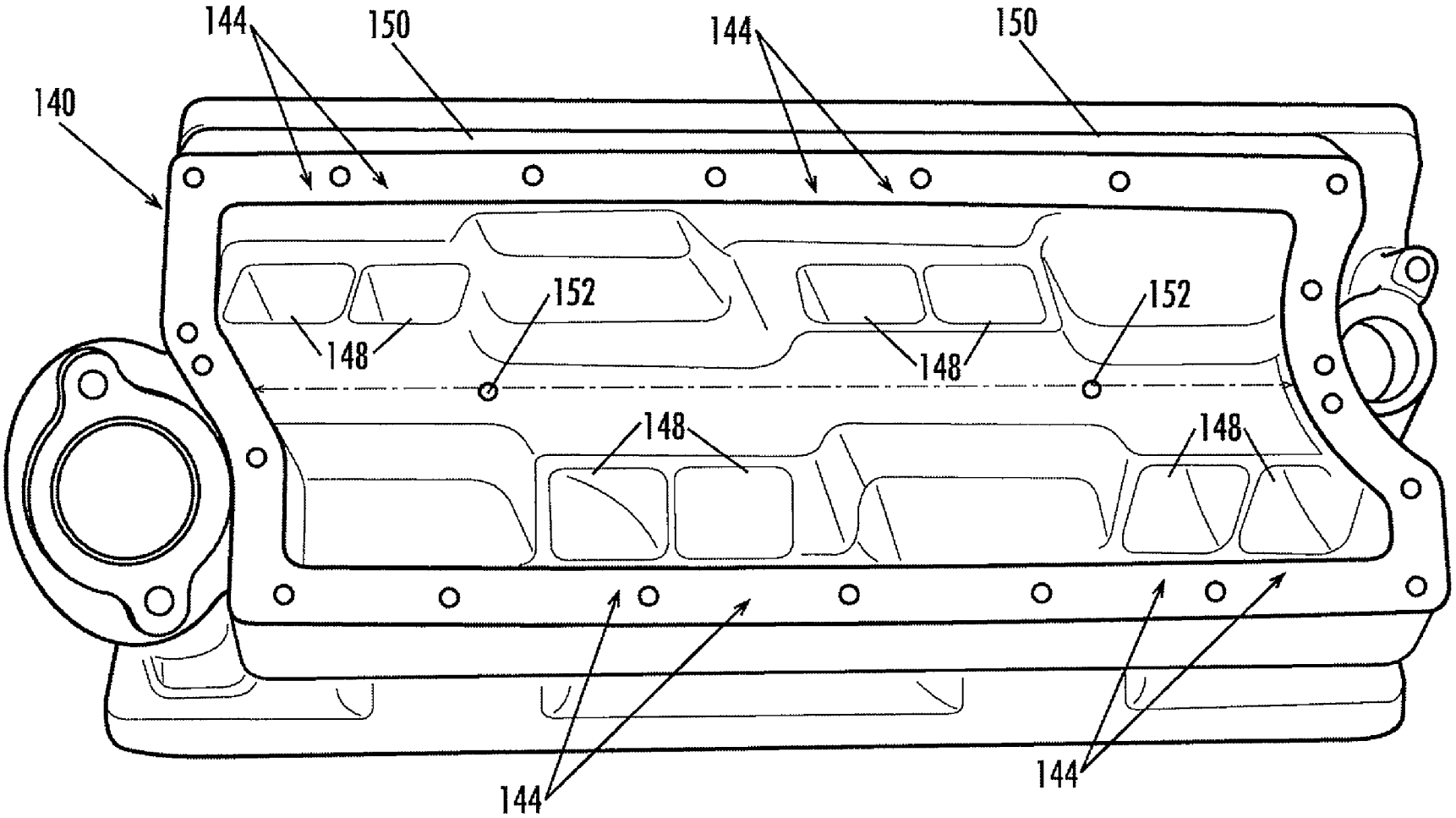
FIG. 7 is a top view of the intake manifold shown in FIG. 6.

The induction system 102 includes an in-line carburetor 104 (FIGS. 1-5) and an intake manifold 140 (FIGS. 6 and 7). The carburetor 104 creates a suspension from air and fuel, and the intake manifold 140 delivers the air and fuel suspension from the carburetor to cylinders of the engine where the air and fuel suspension is combusted to produce mechanical motion. The in-line carburetor 104 and intake manifold 140 enable relatively even distribution of the air and fuel suspension to the cylinders of the engine, as described below.

Figure 1:
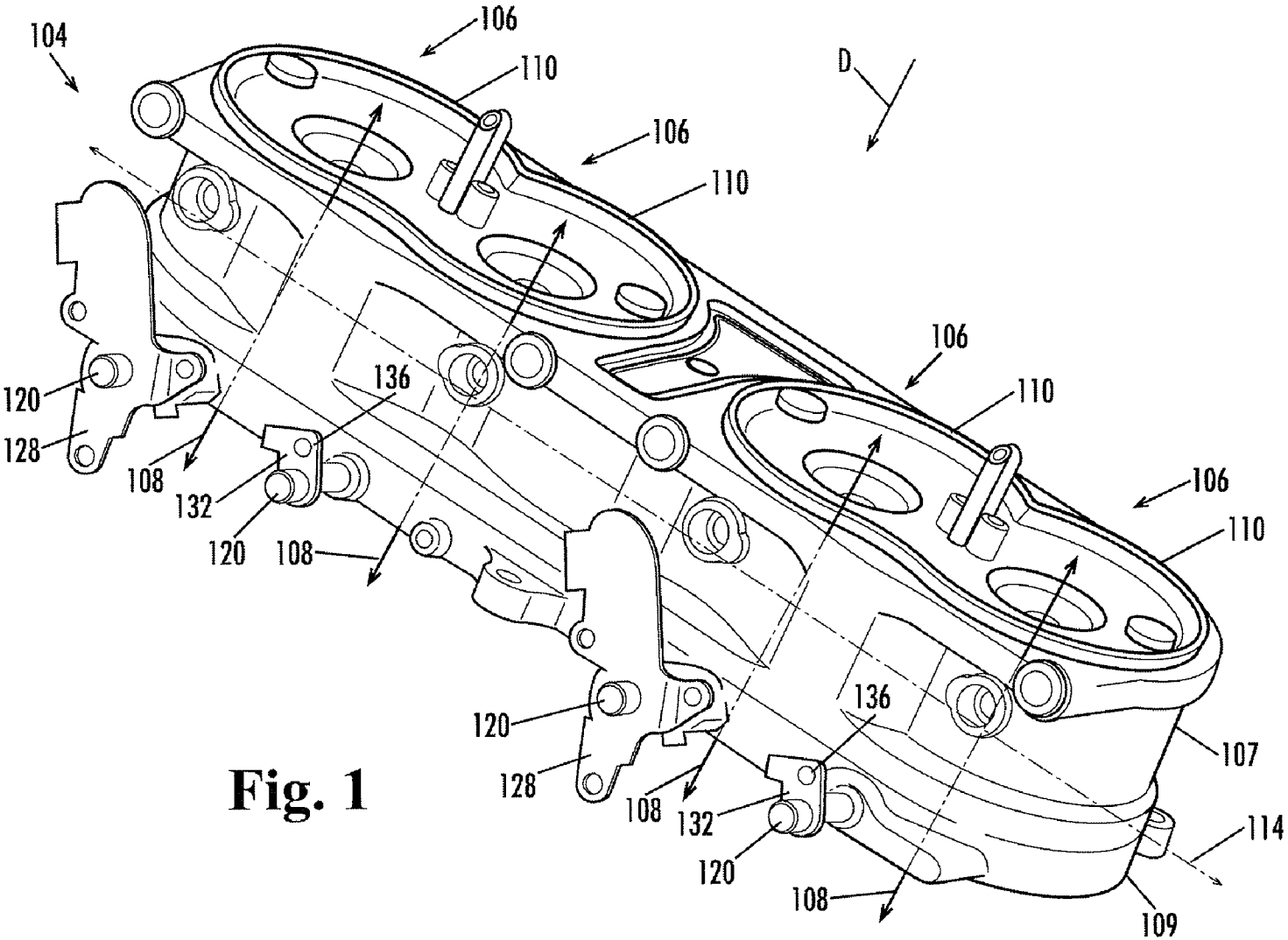
FIG. 1 is a perspective view of an in-line carburetor.
Figure 2:
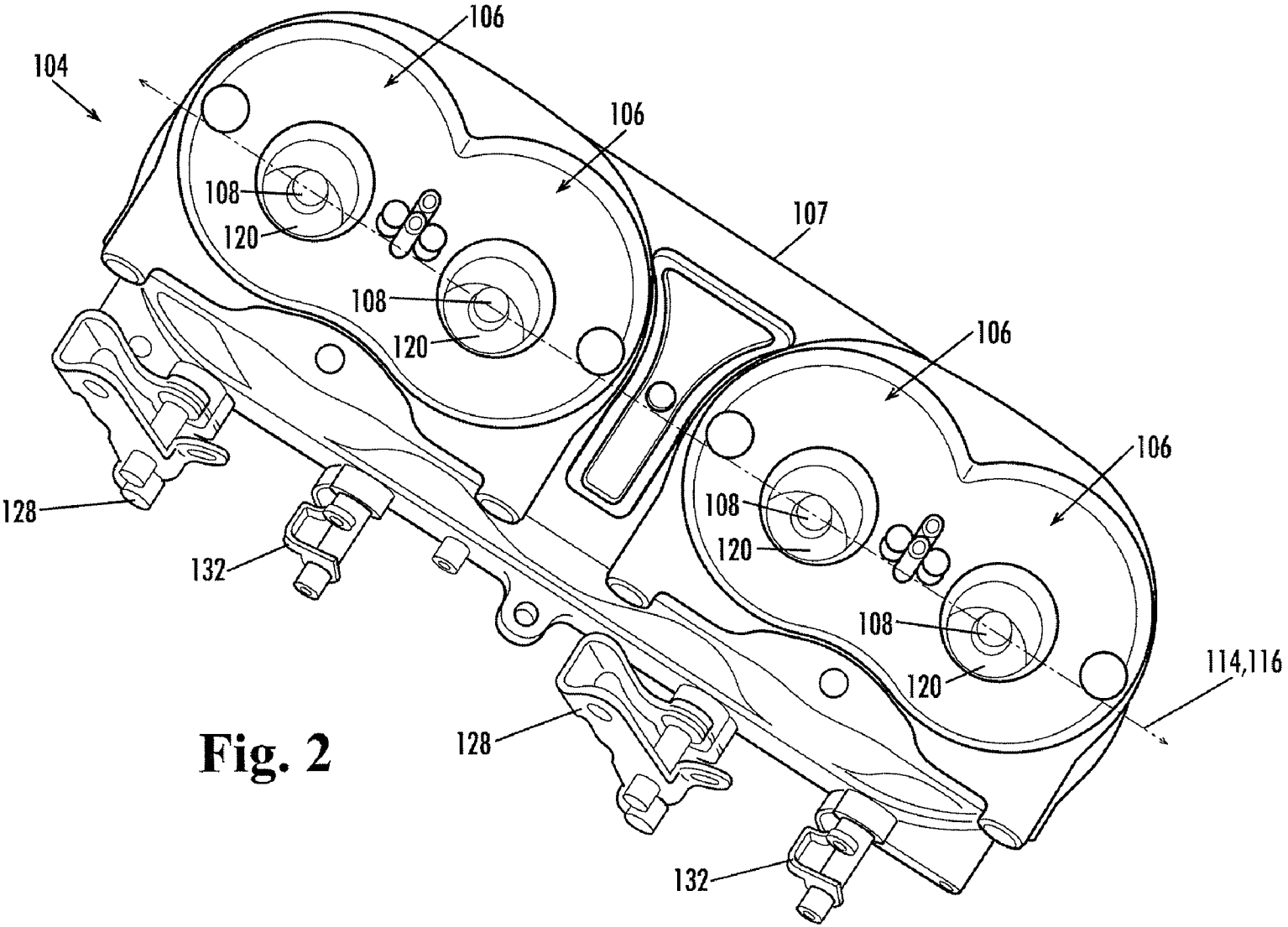
FIG. 2 is a top view of the in-line carburetor shown in FIG. 1.

As shown in FIGS. 1 and 2, the carburetor 104 includes a plurality of cylindrical venturi barrels 106 formed in a row through the body 107 of the carburetor. Carburetor 104 is a four-barrel carburetor having four barrels 106 arranged in the row, although in other embodiments greater or fewer barrels can be provided for different types of engines. Each of the barrels 106 has a longitudinal central axis 108 positioned in the center of the barrel and extending from an entry 110 of the barrel (shown in FIG. 1) to an exit opening (shown in FIG. 3). Air flows through the barrel 106 in a direction of airflow D that is substantially parallel to the central axes 108. An interior surface of the barrel 106 is a venturi surface, meaning the barrel has a minimum cross-sectional area at some intermediate point between the entry 110 and the exit 112 of the barrel, the interior surface converging toward the central axis 108 between the entry and the intermediate point and diverging from the central axis between the intermediate point and the exit. The venturi surface accelerates the air flowing through the barrel 106 and lowers the air pressure so that fuel is drawn into the air through a fuel inlet. The fuel is atomized and dispersed throughout the air to create the air and fuel suspension, which is provided to the intake manifold 140.

As shown in FIG. 1 and FIG. 2, the barrels 106 of the carburetor 104 are aligned in a row along a common axis of alignment 114. The common axis of alignment 114 is perpendicular to the central axes 108 of barrels 106 and extends longitudinally along the carburetor body 107. The common axis of alignment 114 intersects the central axes 108 of the barrels 106, such that the common axis of alignment bisects the barrels and the carburetor body 107. The central axes 108 of the barrels 106 and common axis of alignment 114 define a common plane of alignment 116 of the barrels 106, such that the common plane of alignment bisects the barrels and the carburetor body 107. In FIG. 2, both the common plane of alignment 116 and the central axes 108 project out of the page.

The power output of the engine is determined by the volume of air and fuel suspension combusted within the cylinders, which in turn is determined by the volume of air flowing through the barrels 106. To control the volume of air flowing through the barrels 106, each barrel has a butterfly valve such as butterfly valves 118A, 118B, 118C and 118D, shown in FIG. 3, that can be rotated between opened and closed positions. Each butterfly valve is substantially a circular plate positioned adjacent the exit opening 112, the butterfly valve having a diameter that is substantially the same as but slightly smaller than a diameter of the exit opening. In the closed position, the butterfly valve is at an attitude substantially perpendicular to the central axis 108 of the barrel 106, so that the butterfly valve substantially blocks air from flowing through the barrel. As the butterfly valve moves from its closed position toward its open position, the butterfly valve moves toward an attitude that becomes substantially parallel to the central axis 108 of the barrel 106, so that a relatively large volume of air can flow through the barrel. Between the open and closed positions, the butterfly valve is positioned at an angle with respect to the central axis 108, such that the barrel is partially opened to the degree desired to obtain the appropriate velocity of the air/fuel stream to the engine and the appropriate power output from the engine.

Figure 3:
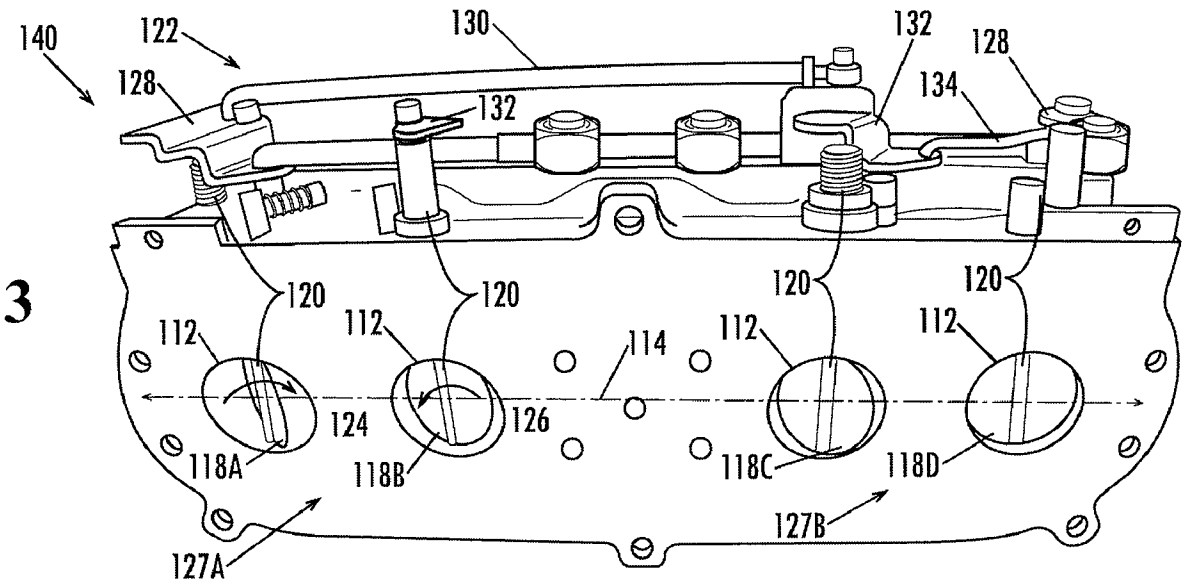
FIG. 3 is a bottom view of the in-line carburetor shown in FIG. 1.

Each butterfly valve is mounted on a butterfly valve control shaft 120, and rotation of the valve control shaft 120 pivots the butterfly valve between the opened and closed positions. The valve control shafts 120 project through the carburetor 104 to a side of the carburetor, where the valve control shafts are coupled together by a control linkage 122 (FIG. 4), described below. As shown in FIG. 3, the valve control shafts 120 are substantially parallel to each other and are spaced apart from each other. More particularly, each valve control shaft 120 is substantially perpendicular to the common plane of alignment 116. Therefore, rotating the valve control shafts 120 pivots the butterfly valves within the bisecting plane 116. In other words, each butterfly valve opens toward the front or the rear of the carburetor 104, instead of toward the side of the carburetor. In other embodiments, the valve control shafts 120 may be angled with respect to the bisecting plane 116, such that the butterfly valves pivot at an angle with respect to the bisecting plane 116.

The butterfly valves are configured to open and close in a progressive, staggered fashion. More particularly, the butterfly valves 118 include primary butterfly valves 118A and 118C and secondary butterfly valves 118B and 118D. The primary butterfly valves 118A, 118C begin opening in advance of the secondary butterfly valves 118B, 118D, such that the primary butterfly valves are at least partially open while the secondary butterfly valves are still in the closed position. For example, in FIG. 3, the primary butterfly valves 118A, 118C are partially opened, while the secondary butterfly valves 118B, 118D are still closed. Once the primary butterfly valves 118A, 118C have opened to a predetermined degree, the secondary valves 118B, 118C begin opening as well. In other words, the secondary butterfly valves 118B, 118D are opened after the primary butterfly valves 118A, 118C have been opened. The top surfaces of the pairs of primary and secondary butterfly valves may be constructed to tilt toward facing relationships as the valves open, so the air/fuel streams moving out of the valves tend to be delivered to concentrated positions 152 in the manifold 150, as described in more detail hereinafter. The pairs of barrels 106, the first and second barrels, and the third and fourth barrels, may be formed in a close relationship with their entries 110 overlapping each other, whereas the second and third barrels are spaced from each other. This also helps to deliver the air/fuel streams toward the concentrated positions 152 in the manifold 150.

The secondary butterfly valves 118B, 118D may open at a faster rate than the primary butterfly valves 118A, 118C, the secondary butterfly valves 118B, 118D having a rotational velocity that exceeds a rotational velocity of the primary butterfly valves 118A, 118C. In some cases, the rotational velocity of the secondary butterfly valves 118B, 118D is selected so that all of the butterfly valves achieve the opened position at substantially the same time. For example, the secondary butterfly valves 118B, 118D may begin opening when the primary butterfly valves 118A, 118C are about 40% open, and may open at a rotational velocity that enables all of the butterfly valves to achieve the open position at the same time even though the primary butterfly valves had a head-start in the opening process.

Providing the carburetor 104 with both primary butterfly valves 118A, 118C and secondary butterfly valves 118B, 118D enables slowly increasing the power output of the engine for smooth acceleration. Otherwise, if all of the butterfly valves began opening at the same time and opened at the same rate, the power output of the engine would quickly increase, causing relatively high acceleration that may cause tire slippage against the pavement.

The butterfly valves open in differing directions, which enables balanced distribution of the air and fuel suspension into the intake manifold 140, as described below. More specifically, the butterfly valves are arranged in pairs 127 along the common axis of alignment 114, each pair including one primary butterfly valve 118A, 118C and one secondary butterfly valve 118B, 118D. Two pairs 127A and 127B are shown in FIG. 3. Within a given pair 127, the butterfly valves rotate toward each other while opening, so that the upper surfaces of the butterfly valves tilt toward facing relationship. The tilted butterfly valves direct the air and fuel suspension to the area between the valves as the valves are opening. This centers the air and fuel suspension between the butterfly valves of the pair 127 for delivering the air/fuel streams toward concentrated positions 152 in the opposite halves of the induction manifold. For example, within the pair 127A, the primary butterfly valve 118A opens by rotating in a clockwise direction of rotation 124, which is opposite from a counterclockwise direction of rotation 126 of the secondary butterfly valves 118B, 118D.

In FIG. 3, the four butterfly valves are arranged in a primary, secondary, primary, secondary fashion. Within the pair 127A, the primary butterfly valve 118A is positioned at an end of the carburetor 104 and the secondary butterfly valve 118B is positioned on an interior of the carburetor. Within the pair 127B, the primary butterfly valve 118C is positioned at the interior of the carburetor 104, and the secondary butterfly valve 118D is positioned at an end of the carburetor. In such an embodiment, both of the primary butterfly valves 118A, 118C rotate open in the same direction, such as the clockwise direction of opening 124, and both of the secondary butterfly valves 118B, 118D open in the same direction, such as the counterclockwise direction of opening 126. In other embodiments, the butterfly valves can have other arrangements. For example, the butterfly valves may be arranged in a primary, secondary, secondary, primary fashion, or in a secondary, primary, primary, secondary fashion. So that the butterfly valves within a pair 127 rotate toward each other in such embodiments, each primary butterfly valve 118A, 118C rotates in an opposite direction of rotation from the other primary butterfly valve, and each secondary butterfly valve 118B, 118D opens in an opposite direction of rotation from the other secondary butterfly valve. Of course, the directions of rotations are selected such that within a given pair 127 the butterfly valves rotate toward each other. Therefore, the air and fuel suspension is directed between the two butterfly valves of a pair 127 as the valves are opening, regardless of the embodiment.

As mentioned above, the carburetor includes a control linkage 122 that actuates the butterfly valves. The control linkage 122 is configured to open the primary butterfly valves 118A, 118C in advance of the secondary butterfly valves 118B, 118D to open the secondary butterfly valves at a faster rate than the primary butterfly valves, and to rotate the butterfly valves of a given pair 127 toward each other while opening. The control linkage 122 is coupled to the valve control shafts 120 of the butterfly valves on the side of the carburetor body 107. More specifically, the control linkage 122 includes a primary actuating lever 128 for each primary butterfly valve 118A, 118C a primary transfer linkage 130 that couples the primary actuating levers 128 together, a secondary actuating lever 132 for each secondary butterfly valve 118B, 118D and a secondary transfer linkage 134 that couples together the secondary actuating lever and the primary actuating lever of a given pair 127 of butterfly valves. In FIGS. 1 and 2, the control linkage 122 is shown with the primary and secondary transfer linkages 130, 134 removed; however, these transfer linkages are shown in FIGS. 3-4.

Each primary actuating lever 128 is coupled to the valve control shaft 120 of a primary butterfly valve 118A, 118C such that rotating the primary actuating lever rotates the primary butterfly valve. The primary transfer linkage 130 extends between and transfers movement between the primary actuating levers 128, so that the primary butterfly valves 118A, 118C open substantially in unison.

Figure 4:
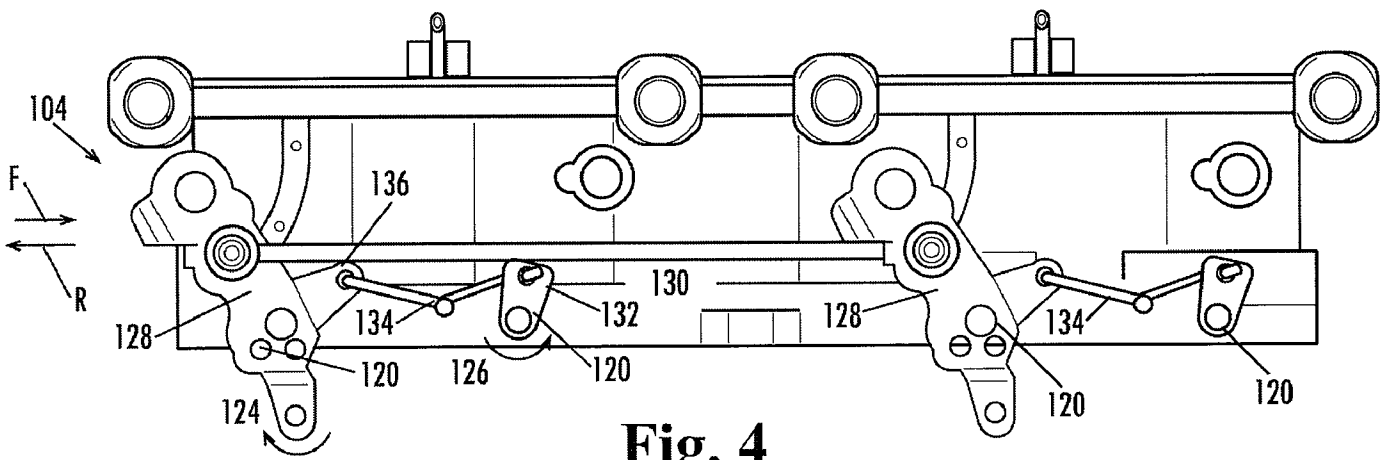
FIG. 4 is a side view of the in-line carburetor shown in FIG. 1.

As shown in FIGS. 3-4, both of the primary actuating levers 128 rotate in the direction of rotation 124, although other configurations are possible in other embodiments. The primary transfer linkage 130 is substantially a rod extending along the side of the carburetor 104 between the two primary actuating levers 128, although other configurations are possible. When one of the primary actuating levers 128 rotates, the primary transfer linkage 130 translates in the forward direction F to impart a force on the other primary actuating lever 128 so that it also rotates. In addition to moving in the forward direction F, the primary transfer linkage 130 also moves in the upward direction.

Each secondary actuating lever 132 is coupled to the valve control shaft 120 of a secondary butterfly valve 118B, 118D, such that rotating the secondary actuating lever rotates the secondary butterfly valve. The secondary transfer linkage 134 couples the secondary actuating lever 132 of a given pair 127 to the primary actuating lever 128 of the same pair. More specifically, the secondary transfer linkage 134 has a fixed end coupled to the primary actuating lever 128 and a movable end coupled to the secondary actuating lever 132. The fixed end of the secondary transfer linkage 134 is coupled to a point on the primary actuating lever 132 that moves away from the secondary butterfly valve as the primary actuating lever rotates. The movable end is positioned in a slot 136 on the secondary actuating lever 132, shown in FIG. 1. When the primary actuating lever 128 begins rotating, the movable end of the secondary transfer linkage 134 translates along the slot 136 so that the secondary butterfly valve 118B, 118D does not begin opening even though the primary butterfly valve 118A, 118C is opening. Once the secondary transfer linkage 134 reaches the end of the slot, continued rotation of the primary actuating lever 128 pulls the secondary transfer linkage toward the primary actuating lever, causing the secondary actuating lever 132 to rotate toward the primary actuating lever. Therefore, the secondary butterfly valve 118B, 118D rotates toward the primary butterfly valve 118A, 118C while opening.

For example, as the primary actuating lever 128 begins rotating in the clockwise direction 124 in FIG. 3, the movable end of the secondary transfer linkage 134 translates along the slot 136 in the rearward direction R in FIG. 4. With continued rotation of the primary actuating lever 128, the movable end encounters the end of the slot 136 and pulls the secondary actuating lever 132 in the rearward direction R, causing the secondary actuating lever 132 to rotate in the counterclockwise direction 126. As a result, the secondary butterfly valve 118B, 118D begins opening after the primary butterfly valves 118A, 118C, the two valves rotating toward each other.

In the illustrated embodiment, the carburetor 104 is configurable. More specifically, the carburetor 104 includes the carburetor body 107 and a base plate 109 that can be detached from and reattached to the body for adjustment purposes. The barrels 106 are formed through both the body 107 and the base plate 109, with the venturi surfaces being positioned within the body 107, and the butterfly valves 118A, 118B, 118C, 118D being positioned within the base plate 109. When assembled, the body 107 and the base plate 109 register with each other. The valve control shafts 120 of the butterfly valves extend through the base plate 109, and the control linkage 122 is coupled to the valve control shafts 120 on the side of the base plate.

As a result of this arrangement, the carburetor 104 is configurable. For example, the venturi surfaces on the interior of the barrels 106 can be formed from interchangeable sleeves that can be inserted into the body 107 by separating the body and the base plate 109, as described in U.S. Pat. No. 5,863,470 entitled "Carburetor with Replaceable Venturi Sleeves", which issued on Jan. 26, 1999 to the Applicant of the present disclosure and is hereby incorporated herein by reference in its entirety. Additionally, the carburetor 104 may have configurable booster venturi sleeves, as described in U.S. Pat. No. 5,807,512 entitled "Carburetor with Replaceable Booster Venturis", which issued on Sep. 15, 1998 to the Applicant of the present disclosure and is hereby incorporated herein by reference in its entirety. The carburetor 104 may also include the air entries described in U.S. Pat. No. 6,120,007 entitled "Carburetor with Color-coded Interchangeable Components", which issued on Sep. 19, 2000 to the Applicant of the present disclosure and is hereby incorporated herein by reference in its entirety. In some embodiments, both the body 107 and the base plate 109 are formed from lightweight cast aluminum, although other configurations are possible. Additionally, the carburetor 104 may include adjustment screws. For example, the carburetor 104 includes three adjustment screws in some embodiments, including two idle-mixture screws and one idle-speed screw.

FIG. 5 is a bottom view of a portion of the carburetor 104, illustrating an embodiment of the fuel-metering circuits for one pair 127 of the barrels 106. The carburetor 104 includes four principal fuel-metering circuits: idle, main, power enrichment, and accelerator pump. The idle circuits draw air through the small brass idle-air bleeds in the air entries. Idle fuel is drawn from the main wells and dispersed via the idle discharge orifices and transfer slots located in the billet base plate. The main circuits, which are controlled by the orifice of the main jets, draw air through the small brass high-speed bleeds in the air entries and discharge through the boost venturi, located in the center of the main venturi. The power enrichment fuel circuits, which respond to falling engine vacuum, add fuel to the main circuits. Finally, the accelerator-pump mechanisms discharge their mixtures through the accelerator-pump nozzles (squirters), which are located between the fuel bowl vent tubes in the center of the air entries.

The carburetor 104 also includes an integral fuel bowl, which may eliminate fuel leaks by eliminating the gaskets that may leak under the float level. When the carburetor is disassembled, the air and fuel metering circuits and float mechanisms are exposed for inspection. All of the tuning components with the exception of the accelerator-pump mechanisms are contained within removable assemblies, which make carburetor maintenance- and tuning-convenient.

As mentioned above, the air and fuel suspension created by the carburetor 104 is delivered to an intake manifold 140, which delivers the air and fuel suspension in separate streams to each cylinder of the engine. The intake manifold 140 is shown in FIGS. 6-7. The intake manifold 140 includes a plenum 142, or a common receiving chamber, and a plurality of runners 144, or channels. The plenum 142 is configured to receive the air and fuel suspension from the barrels 106 on the carburetor 104 and to deliver the air and fuel suspension to the runners 144. The runners 144 are configured to deliver the air and fuel suspension from the plenum 142 to the engine, such as the engine 800 shown in FIGS. 8-10. More particularly, the intake manifold 140 may have one runner 144 for each cylinder of the engine 800, and each runner may extend from the plenum 140 toward an intake valve 802 into a cylinder (FIG. 10).

The plenum 142 is about the same length and width as the carburetor body 107, such that when the intake manifold 140 is coupled to the carburetor 104, the exits 112 of all of the barrels 106 are adjacent the plenum 142. A central axis 146 substantially bisects the plenum, and openings 148 into half of the runners 144 are located on either side of the central axis. For example, in FIG. 7 the intake manifold has eight runners 144, and therefore four openings 148 are located on opposite sides of the central axis 146. The openings 148 are spaced along the entire central axis 146 such that no one opening is farther away from the central axis than any other opening. For example, in FIG. 7 the openings 148 are spaced in groups of two along the entire central axis 146, although other configurations may be possible. The openings 148 are pitched or angled so that a bottom of the opening is farther away from the central axis than a top of the opening, as shown in FIG. 6. Because of the pitch, the cross-sectional area of the opening 148 is relatively larger than it would be if the opening were oriented upright, facilitating the flow of air and fuel suspension into the opening.

The runners 144 extend from the openings 148 on one side of the central axis 146 through the intake manifold body and to an exit on the other side of the central axis (not shown). Each of the runners 144 is substantially the same length, between the opening 148 and the exit. The runners 144 are symmetrically disposed about a plane that includes the central axes 146 and substantially bisects the intake manifold 140, which is the common plane of alignment 116 of the carburetor when the two components are coupled together. In the illustrated embodiment, the intake manifold 140 is cast aluminum, although other configurations are possible.

Figure 9:
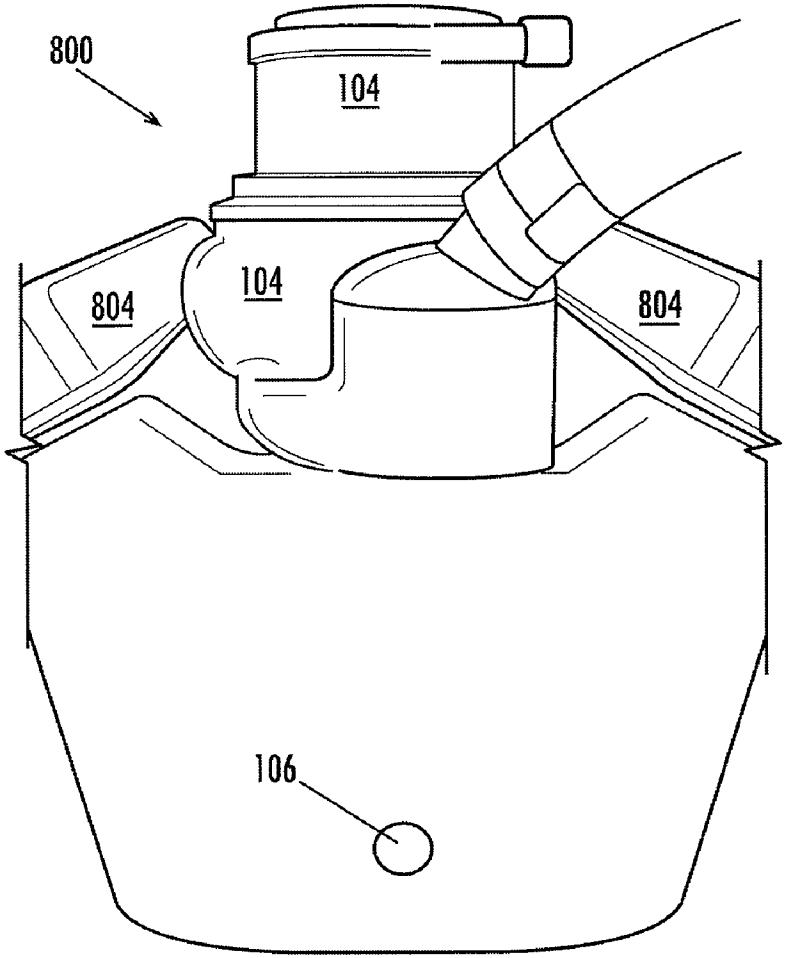
FIG. 9 is a front view of the internal combustion engine shown in FIG. 8.
Figure 8:
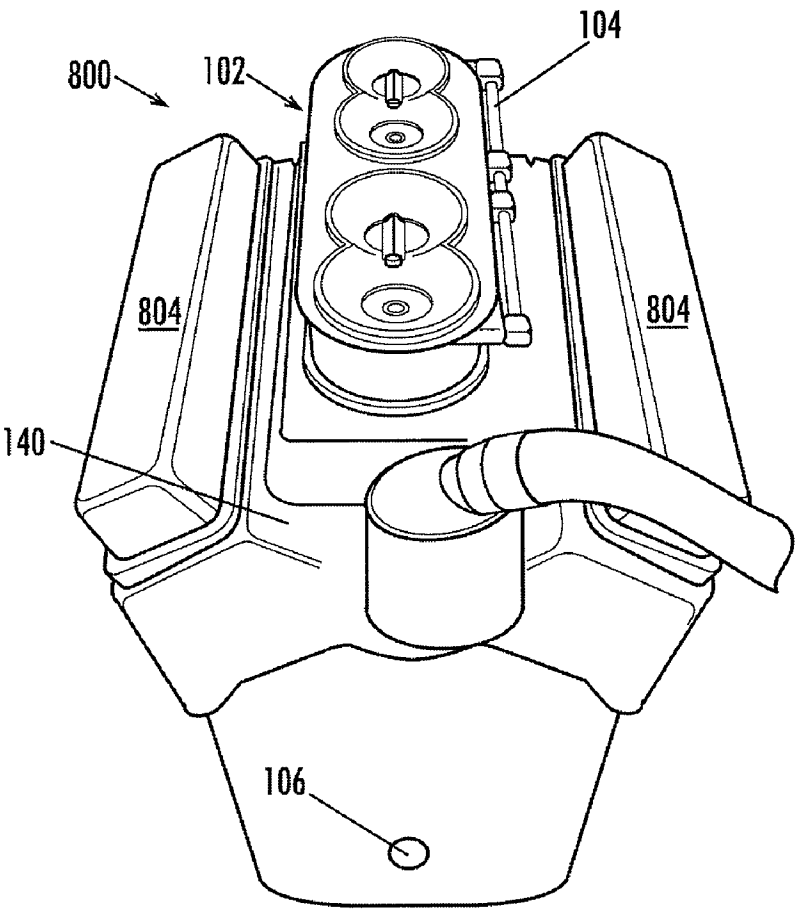
FIG. 8 is a perspective view of an internal combustion engine that includes the in-line carburetor of FIG. 1 and the intake manifold of FIG. 6.
Figure 10:
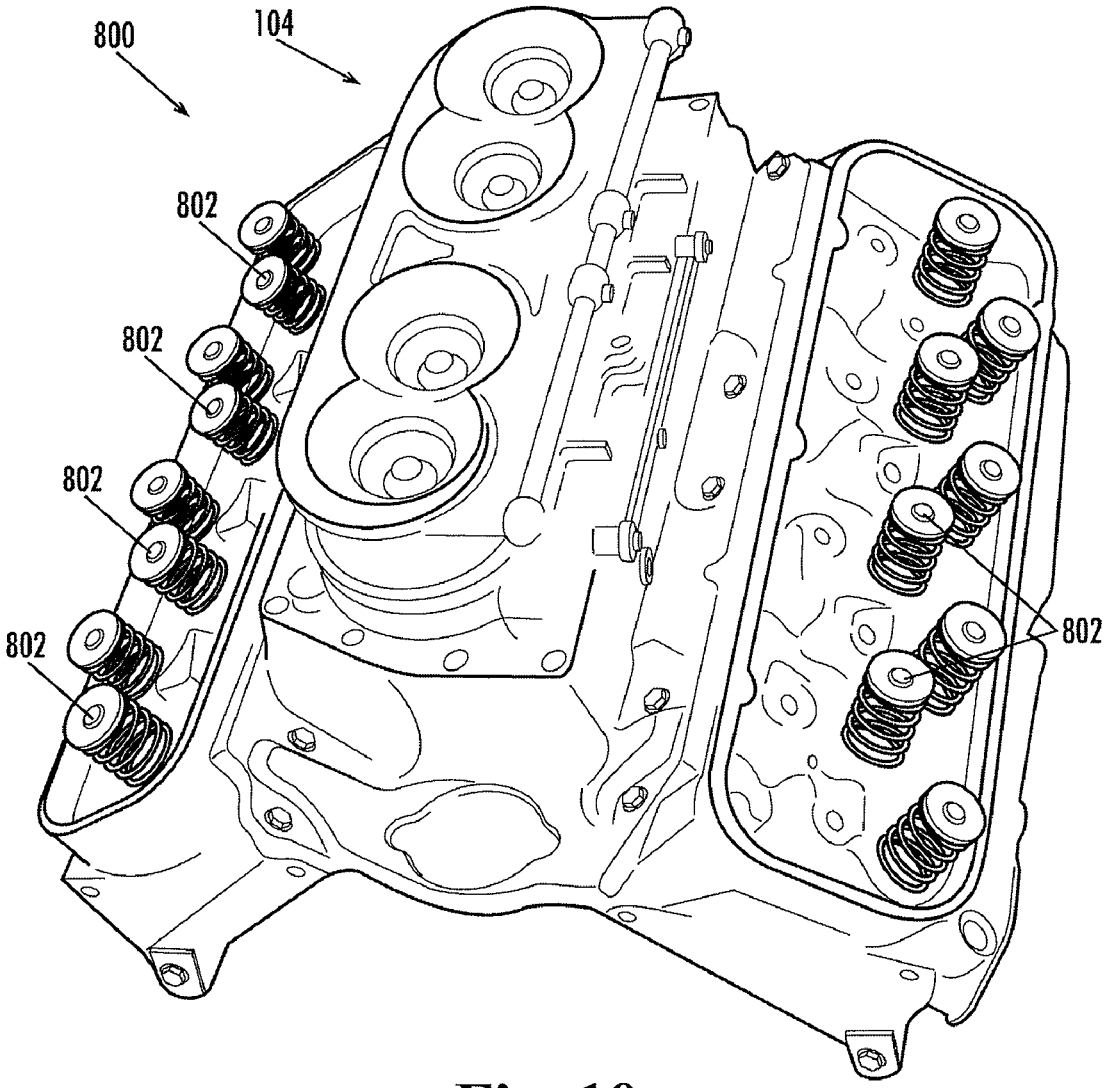
FIG. 10 is a perspective view of the internal combustion engine shown in FIG. 8.

FIGS. 8-10 are top, side, and perspective views of an internal combustion engine 800 that includes the induction system 102. As mentioned, the illustrated engine 800 is a V-8 engine having eight cylinders arranged in a V-orientation. The cylinders form two separate banks 804, each bank having four cylinders arranged in a row and connected by a common cylinder head. The two banks 804 form an angle with respect to each other, and at an intersection of the two banks is a crankvalve control shaft 806 that is coupled to a piston (not shown) within each cylinder. When the air and fuel suspension is combusted within a cylinder, a pressure is created that drives the piston to rotate the crankvalve control shaft 806. Thereby, mechanical motion results.

To supply the air and fuel suspension to the cylinders, the induction system 102 is positioned above the engine block. More specifically, the carburetor 104 is mounted on the intake manifold 140, and the intake manifold is mounted on the engine block between the two cylinder banks 804. The common axis of alignment 114 of the carburetor 104 is substantially aligned with the central axis 146 of the intake manifold 140 and the crankvalve control shaft 806 of the engine. In other words, the central axis 146 of the intake manifold 140 and the crankvalve control shaft 806 of the engine 800 then lie in the common plane of alignment 116 that bisects the barrels 106 of the carburetor 104.

In use, the cylinders of the engine 800 do not fire simultaneously. Instead, the cylinders operate in a staggered fashion with respect to each other. The carburetor 104 continuously feeds the air and fuel suspension into the plenum 142 of the intake manifold 140, where the air and fuel suspension is distributed to the cylinders on an as needed basis. More specifically, when the intake valve 802 of a cylinder opens, the air and fuel suspension is drawn from the plenum 142 through the runner 144. Such an arrangement enables intermittent servicing of a plurality of cylinders with the full-output of a larger carburetor. Because the fuel within the air and fuel suspension has different physical characteristics than the air in which it is suspended, such as inertial differences, the air and fuel suspension may favor entering the opening into one cylinder over another. To mitigate these effects, the carburetor 104 tends to feed the plenum 142 of the intake manifold 140 along the central axis 146 of the intake manifold 140, and the runners are symmetrically disposed with respect to the bisecting plane 116.

More specifically, the barrels 106 are aligned with the central axis 146 of the intake manifold 140 and the butterfly valves open by rotating in the bisecting plane 116, so that the air and fuel suspension flowing through the butterfly valves into the plenum 142 tends to be centered with respect to the central axis of the intake manifold and is not preferentially directed toward runners 144 located on either side of the central axis of the intake manifold. Each half 150 of the plenum is positioned adjacent one primary butterfly valve 118A, 118C and the primary butterfly valves open substantially in unison, so that the air and fuel suspension is equally dispersed between the two halves of the plenum 142 and is not preferentially directed toward runners 144 located in one half of the plenum versus the other half. The primary butterfly valve 118A, 118C opens toward the secondary butterfly valve 118B, 118D with which it is paired, so that the air and fuel suspension flowing through the partially open butterfly valve is directed toward a center 152 of the half 150 of the intake manifold 104 it is servicing. When the primary butterfly valves 118A, 118C have opened to a predetermined degree, the secondary butterfly valves 118B, 118D begin opening substantially in unison toward the primary butterfly valve of its pair 127. Therefore, each half 150 of the intake manifold 140 is serviced with substantially the same volume of air and fuel suspension. The air and fuel suspension tends to be fed along the central axis 146 of the intake manifold 140 and is directed toward the centers 152 of the intake manifold halves without being directed toward particular runners 144 located on one side of the central axis 146 versus the other. This delivers the air/fuel suspensions from the carburetor to the concentrated positions 152 in the halves of the manifold that are substantially equidistant from the entries of the induction runners at each end of the manifold.

The openings 148 into the runners 144 are substantially the same distance from the central axis 146, and are sloped away from the central axis, so that the air and fuel suspension can enter the openings without a significant change in direction. Further, the runners 144 are symmetrically disposed with respect to the bisecting plane 116. Therefore, in embodiments in which the intake manifold 140 is substantially the same length as the engine block, the distance from the central axis 146 of the intake manifold 140 to the intake valve 802 of the cylinder may be substantially the same through each runner 144. In other words, a path that the air and fuel suspension travels from the central axis 146 to the intake valve 802 may be relatively the same in terms of length and angle, despite the fact that different cylinders are located at different positions along the cylinder banks. Equalizing the path traveled by the air and fuel suspension is desirable, because such a configuration enables selecting characteristics of the air and fuel suspension based on the desired performance of the engine, and ensuring the air and fuel suspension entering the intake valves 802 embodies those characteristics regardless of the cylinder to which it is delivered.

Because the fuel is not directed to one central position in the plenum and then distributed out to the cylinders through runners having varied shapes and sizes, the engine 800 is more likely to exhibit lower fuel consumption, improved low-speed idle, improved part-throttle driveability, and improved combustion. The equal length runners 144 allow a larger camvalve control shaft, such as a performance camvalve control shaft, to operate at low engine speeds with low vacuum.

The induction system 102 of the present disclosure can be used with a variety of engine types and sizes including other V-8 engines as well as engines having greater or fewer cylinders and engines having cylinders that are not arranged in a V-orientation. In such embodiments, the carburetor 104 may have greater or fewer barrels 106, and the intake manifold 140 may have greater or fewer runners 144.

While particular embodiments of an induction system have been disclosed in detail in the foregoing description and figures for purposes of example, those skilled in the art will understand that variations and modifications may be made without departing from the scope of the disclosure. All such variations and modifications are intended to be included within the scope of the present disclosure, as protected by the following claims.

At least the following is claimed:

1. An induction system for an internal combustion engine that includes combustion cylinders in banks arranged in a V-shaped orientation, said induction system comprising:

a carburetor including;

a plurality of barrels formed through a body of the carburetor, the barrels being aligned along a common plane of alignment such that the barrels are substantially arranged in a row, each barrel having a central axis that extends through substantially a center of the barrel from an entry to an exit of the barrel, the barrels being positioned within the carburetor body such that the central axes are substantially parallel to one another, the central axis of any one of the barrels and the common plane of alignment of all of the barrels that substantially bisects the barrels;

a plurality of butterfly valves, each barrel having one of the butterfly valves, each butterfly valve having a valve control shaft, the valve control shaft being substantially perpendicular to the bisecting plane that substantially bisects the barrels, each butterfly valve being one of a primary butterfly valve or a secondary butterfly valve, the primary butterfly valves beginning to open in advance of the secondary butterfly valves and opening at a slower rotational velocity than the secondary butterfly valves, the butterfly valves being arranged in pairs, each pair including one primary butterfly valve and one secondary butterfly valve, the primary butterfly valve of the pair opening in a direction of opening that is opposite from a direction of opening of the secondary butterfly valve of the pair, the butterfly valves of the pair rotating toward each other while opening to direct air and fuel suspension between the butterfly valves; and a control linkage coupled to the valve control shafts of the butterfly valves that pivots the butterfly valves within the barrels to move the butterfly valves between opened and closed positions, the butterfly valves pivoting within the bisecting plane that substantially bisects the barrels, the control linkage including a primary actuating lever for each primary butterfly valve, the primary actuating lever pivoting the valve control shaft of the primary butterfly valve to open the primary butterfly valve, each of the primary actuating levers being coupled together by a primary transfer linkage that transfers the motion of one primary actuating lever to the other primary actuating lever so that the primary butterfly valves open substantially in unison, the control linkage further including a secondary actuating lever for each secondary butterfly valve, the secondary actuating lever pivoting the valve control shaft of the secondary butterfly valve to open the secondary butterfly valve, each of the secondary actuating levers being coupled to the primary actuating lever that corresponds to the primary butterfly valve with which the secondary butterfly valve is a pair, the secondary transfer linkage having a fixed end and a movable end, the fixed end being coupled to a point on the primary actuating lever that moves away from the secondary actuating lever as the primary actuating rotates and the movable end being positioned in a slot on the secondary actuating lever, such that when the primary actuating lever rotates, the movable end translates along the slot toward the primary actuator, catches against the end of the slot and is pulled by the primary actuating lever in a direction of opening that is opposite from the direction of opening of the primary actuating lever, so that the secondary butterfly valve begins opening after the primary butterfly valve, and opens toward the primary butterfly valve; and an intake manifold including;

a plenum that is about the same length and width as the carburetor body, the plenum having a central axis that is aligned with the bisecting plane of the carburetor and substantially bisects the plenum; and a plurality of runners that are symmetrically disposed with respect to the bisecting plane, each of the runners being substantially the same length and extending from an opening in the plenum to an intake valve into a cylinder of the engine, the openings into half of the runners being located on either side of the bisecting plane, the openings being spaced along the bisecting plane in groups of two, each opening being substantially the same distance from the bisecting plane, each opening being angled away from the bisecting plane so that a bottom of the opening is farther away from the bisecting plane than a top of the opening;

wherein the induction system is mounted on the engine having combustion cylinders in banks arranged in a V-shaped orientation, the carburetor being mounted above the intake manifold and the intake manifold being mounted on an engine block of the engine and spanning between two cylinder banks of the engine, such that the common axis of alignment of the carburetor barrels and the central axis of the plenum of the intake manifold are aligned along the bisecting pane, the carburetor creating an air and fuel suspension that is combusted within cylinders positioned within the cylinder banks, the air and fuel suspension being fed from the barrels of the carburetor into the plenum along the central axis and into runners, a path from the central axis to an intake valve of the cylinder being substantially the same length for each runner.

2. An induction system for a V-8 combustion engine having banks of cylinders arranged in a V-shape, with a first four cylinders at one end portion of the engine and a second four cylinders at the other end of the engine, the induction system comprising:

a four barrel carburetor body having in sequence first, second, third and fourth barrels, with the barrels arranged in a row, a first and third barrels comprising primary barrels and the second and fourth barrels comprising secondary barrels, butterfly valves in alignment with each of the barrels for controlling the air/fuel streams passing through the barrels, a valve linkage connected to the butterfly valves and configured for opening the butterfly valves of the primary barrels and for opening the butterfly valves of the secondary barrels after the butterfly valves of the primary barrels are opened.

3. The induction system for a V-8 combustion engine as set forth in claim 2, wherein the valve linkage is configured to rotate the butterfly valves of the primary barrels in opposite directions from the rotation of the butterfly valves of the secondary barrels.

4. The induction system for a V-8 combustion engine of claim 2, wherein the barrels are arranged in a common plane and the control linkage is configured to tilt the butterfly valves about axes transverse to the common plane of the barrels.

5. The induction system for a V-8 combustion engine of claim 3, and further including an intake manifold in communication with the barrels of the carburetor for receiving air/fuel streams from the carburetor, and with induction runners extending from the intake manifold to the cylinders of the engine for delivering air/fuel streams from the intake manifold to the cylinders of the engine.

6. The induction system for a V-8 combustion engine as described in claim 5, wherein the induction runners are substantially of equal length.

7. The induction system for a V-8 combustion engine as described in claim 5, wherein:

the intake manifold has opposed first and second ends, with the first end of the intake manifold in communication with the first and second barrels of the carburetor and the second end of the intake manifold in communication with the third and fourth barrels of the carburetor, the induction runners are arranged in a first group of four runners and a second group of four runners, with the first group of four runners in communication with the first end of the induction manifold and the first four cylinders of the engine and the second group of four runners in communication with the second end of the induction manifold and the second group of four cylinders of the engine.

8. An induction system for an internal combustion engine with an even number of cylinders, the cylinders of the engine being arranged in two banks of cylinders in a V-shaped configuration with one another, with a first half of the cylinders at one end of the engine and a second half of the cylinders at the other end of the engine, said induction system comprising:

a carburetor for mounting to the engine, said carburetor including;

four open ended barrels extending through the carburetor, all of the barrels being aligned along a common plane for extending between the two banks of the engine for passing air/fuel streams to the cylinders of the engine, a butterfly valve arranged in alignment with each barrel for controlling the flow of air/fuel streams through the barrels of the carburetor, a control linkage connected to the butterfly valves, said control linkage configured to tilt the butterfly valves about axes transverse to the common plane of the barrels, with two of the butterfly valves being tiltable in clockwise directions from their closed positions toward their open positions and the other two butterfly valves being tiltable in counterclockwise directions from their closed positions to their open positions, an intake manifold arranged to receive the air/fuel streams from the four open ended barrels, and induction runners in communication with the intake manifold for extending to the cylinders of the engine and delivering the air/fuel streams to the cylinders of the engine.

9. The induction system for an internal combustion engine of claim 8, wherein the barrels of the carburetor are positioned in sequence of first, second, third and fourth barrels, with the barrels arranged in a row, and the intake manifold has a first end and a second end, the first end of the induction manifold in communication with the first and second barrels and the second end of the intake manifold in communication with the third and fourth barrels, and a first group of the induction runners in communication with the first end of the intake manifold and with the cylinders at a first end of the engine, and a second group of the induction runners in communication with the second end of the intake manifold and with the cylinders at the second end of the engine.

10. The induction system for an internal combustion engine of claim 8, wherein the first and second barrels of the carburetor intersect each other and the third and fourth barrels of the carburetor intersect each other.

11. The induction system for an internal combustion engine of claim 10 wherein the second and third barrels are spaced from each other.

12. The induction system for an internal combustion engine of claim 8, wherein the first and second barrels of the carburetor are positioned to be mounted adjacent the cylinders at one end of the engine, and the third and fourth barrels of the carburetor are positioned to be mounted adjacent the cylinders at the other end of the engine.

13. The induction system for an internal combustion engine of claim 8, wherein the control linkage is configured to tilt the butterfly valves about axes transverse to the common plane of the barrels, such that the butterfly valves of each pair of butterfly valves rotate in opposite directions so that their upper surfaces tilt toward a facing relationship and direct major portions of the air/fuel streams between the butterfly valves and toward a concentrated area beyond the butterfly valves into the intake manifold.

14. An induction system for an internal combustion engine having combustion cylinders, the cylinders of the engine being arranged in two banks of cylinders in a V-shaped configuration with one another, with a first half of the cylinders at one end of the engine and a second half of the cylinders at the other end of the engine, said induction system comprising:

an intake manifold for mounting to the engine, a carburetor mounted to the intake manifold, said carburetor including;

four open ended barrels extending through the carburetor, all of the barrels being aligned along a common plane for extending between the two banks of the engine for passing air/fuel streams to the cylinders of the engine, a butterfly valve arranged in alignment with each barrel for controlling the flow of air/fuel streams through the barrels of the carburetor, a control linkage connected to the butterfly valves, said control linkage configured to tilt the butterfly valves about axes transverse to the common plane of the barrels, with two of the butterfly valves being tiltable in clockwise directions from their closed positions toward their open positions and the other two butterfly valves being tiltable in counterclockwise directions from their closed positions to their open positions, an intake manifold arranged to receive the air/fuel streams from the four open-ended barrels, and induction runners in communication with the intake manifold for extending to the cylinders of the engine and delivering the air/fuel streams to the cylinders of the engine.

15. The induction system for an internal combustion engine of claim 13, wherein the first and second barrels of the carburetor are positioned to be mounted adjacent the cylinders at one end of the engine, and the third and fourth barrels of the carburetor are positioned to be mounted adjacent the cylinders at the other end of the engine.

16. The induction system for an internal combustion engine of claim 14, wherein the runners are connected to opposite ends of the manifold for connection to the cylinders at opposite ends of the engine.

17. An induction system for an internal combustion engine having combustion cylinders, with a first half of the cylinders at one end of the engine and a second half of the cylinders at the other end of the engine, said induction system comprising:

an intake manifold for mounting to the engine, a carburetor mounted to the intake manifold, said carburetor including;

at least two pairs of open ended barrels extending through the carburetor, all of the barrels being aligned along a common plane for passing air/fuel streams to the cylinders of the engine, each pair of barrels including a primary barrel and a secondary barrel, a butterfly valve arranged in alignment with each barrel for controlling the flow of air/fuel streams through the barrels of the carburetor, a control linkage connected to the butterfly valves, said control linkage configured to tilt the butterfly valves about axes transverse to the common plane of the barrels, with the butterfly valves of the primary barrels being tiltable in a first direction from their closed positions toward their open positions to have their top surfaces face the secondary barrels, and the butterfly valves of the secondary barrels being tiltable in the opposite direction from their closed positions to their open positions to have their top surfaces face the primary barrels, the intake manifold arranged to receive the air/fuel suspension from each of the pairs of open-ended barrels at spaced positions along the length of the manifold, induction runners in communication with the intake manifold adjacent the spaced positions along the length of the manifold for extending from the spaced positions in the manifold to the cylinders most closely adjacent to the spaced positions in the manifold at each end of the engine and delivering the air/fuel streams to the cylinders of the engine, such that the induction runners are of substantially equal lengths.

* * * * *